US007696455B2

(12) United States Patent
Lin et al.

(10) Patent No.: US 7,696,455 B2
(45) Date of Patent: Apr. 13, 2010

(54) POWER TERMINALS FOR CERAMIC HEATER AND METHOD OF MAKING THE SAME

(75) Inventors: Hongy Lin, Chesterfield, MO (US); Thomas M. Laskowski, Pacific, MO (US); Jason E. Smith, St. Louis, MO (US)

(73) Assignee: Watlow Electric Manufacturing Company, St. Louis, MO (US)

( * ) Notice: Subject to any disclaimer, the term of this patent is extended or adjusted under 35 U.S.C. 154(b) by 0 days.

(21) Appl. No.: 11/416,836

(22) Filed: May 3, 2006

(65) Prior Publication Data

US 2007/0257022 A1 Nov. 8, 2007

(51) Int. Cl.
*H05B 3/68* (2006.01)
*H05B 3/08* (2006.01)

(52) U.S. Cl. ..... 219/443.1; 219/541

(58) Field of Classification Search ..... 219/443–468.2, 219/538–544; 118/724, 725
See application file for complete search history.

(56) References Cited

U.S. PATENT DOCUMENTS

| | | | | |
|---|---|---|---|---|
| 3,676,211 | A | 7/1972 | Koutesis et al. | |
| 4,803,345 | A | 2/1989 | Hoshizaki et al. | |
| 5,146,313 | A * | 9/1992 | Kato et al. | 257/764 |
| 5,573,690 | A | 11/1996 | Nobori et al. | |
| 5,633,073 | A * | 5/1997 | Cheung et al. | 428/209 |
| 5,670,063 | A | 9/1997 | Hegner et al. | |
| 5,705,261 | A | 1/1998 | Axelson | |
| 5,753,893 | A | 5/1998 | Noda et al. | |
| 6,291,804 | B1 | 9/2001 | Fujii | |
| 6,512,210 | B2 | 1/2003 | Tanaka et al. | |
| 6,653,601 | B2 | 11/2003 | Taniguchi et al. | |
| 6,677,557 | B2 | 1/2004 | Ito et al. | |
| 6,720,530 | B2 | 4/2004 | Taniguchi et al. | |
| 6,787,741 | B2 | 9/2004 | Tanaka et al. | |
| 6,794,614 | B2 | 9/2004 | Taniguchi et al. | |
| 6,825,448 | B2 * | 11/2004 | Gianoulakis | 219/443.1 |
| 6,835,916 | B2 | 12/2004 | Ito et al. | |
| 6,929,874 | B2 | 8/2005 | Hiramatsu et al. | |
| 2002/0185487 | A1 * | 12/2002 | Divakar et al. | 219/444.1 |
| 2003/0080110 | A1 * | 5/2003 | Hiramatsu et al. | 219/466.1 |
| 2004/0011287 | A1 | 1/2004 | Ootsuka | |
| 2004/0074606 | A1 | 4/2004 | Ootsuka et al. | |
| 2004/0140040 | A1 | 7/2004 | Hiramatsu et al. | |
| 2004/0211767 | A1 | 10/2004 | Hiramatsu et al. | |
| 2005/0045618 | A1 | 3/2005 | Ito | |
| 2006/0182908 | A1 | 8/2006 | Fujii | |

FOREIGN PATENT DOCUMENTS

| | | |
|---|---|---|
| DE | 42 40 812 | 6/1994 |
| EP | 0 374 475 | 6/1990 |
| EP | 0 653 898 | 5/1995 |
| JP | 2003 124296 | 4/2003 |

* cited by examiner

*Primary Examiner*—Sang Y Paik
(74) *Attorney, Agent, or Firm*—Brinks Hofer Gilson & Lione

(57) ABSTRACT

A ceramic heater is provided that includes a power terminal for connecting a resistive heating element to a power source. An intermediate layer is disposed on an AlN ceramic substrate proximate the resistive heating element. The power terminal is bonded to the intermediate layer by an active brazing material. The intermediate layer is formed of Mo/AlN or W/AlN and has a coefficient of thermal expansion between that of the active brazing material and that of the AlN ceramic substrate so that thermal stress generated in the ceramic substrate can be reduced.

8 Claims, 6 Drawing Sheets

POWER TERMINALS FOR CERAMIC HEATER AND METHOD OF MAKING THE SAME

FIELD

The present disclosure relates generally to ceramic heaters, and more particularly to power terminals for ceramic heaters and methods of securing the power terminals to the ceramic heaters.

BACKGROUND

The statements in this section merely provide background information related to the present disclosure and may not constitute prior art.

A typical ceramic heater generally includes a ceramic substrate and a resistive heating element either embedded within or secured to an exterior surface of the ceramic substrate. Heat generated by the resistive heating element can be rapidly transferred to a target object disposed proximate the ceramic substrate because of the excellent heat conductivity of ceramic materials.

Ceramic materials, however, are known to be difficult to bond to metallic materials due to poor wettability of ceramic materials and metallic materials. Moreover, the difference in coefficient of thermal expansion between the ceramic material and the metallic material is significant and thus a bond between the ceramic material and the metallic material is difficult to maintain.

Conventionally, a power terminal is attached to the ceramic substrate in one of two methods. In the first method, a metal foil is brazed to a part of the resistive heating element to form a terminal pad, followed by brazing the power terminal to the metal foil. The metal foil and the power terminal are brazed to the ceramic substrate in a non-heating zone to avoid generation of thermal stress at high temperatures during operation. Creating a non-heating zone solely for the purpose of securing the power terminal, however, does not seem practical and economical, given the trend of compact designs in many areas including the ceramic heaters.

The second method involves drilling a hole in the ceramic substrate to expose a part of the resistive heating element and placing the power terminal within the hole, followed by filling the hole with an active brazing alloy to secure the power terminal to the resistive heating element and the ceramic substrate. Unlike the first method, the power terminal of the second method is secured to the ceramic substrate in a heating zone. Again, the incompatible thermal expansion among the ceramic materials, active brazing alloy and metallic materials causes thermal stress at high temperatures at the interface between the ceramic substrate and the active brazing alloy, resulting in cracks in the ceramic substrate proximate the hole.

SUMMARY

In one form, a ceramic heater is provided that includes a ceramic substrate, a resistive heating element attached to the ceramic substrate, a terminal adapted for electrically connecting the resistive heating element to a power source, and an intermediate layer disposed between the terminal and the ceramic substrate. The intermediate layer is selected from a group consisting of molybdenum/aluminum nitride (Mo/AlN) and tungsten/aluminum nitride (W/AlN).

In another form, a ceramic heater comprises a ceramic substrate including a recess, a resistive heating element embedded within the ceramic substrate, and a terminal for connecting the resistive heating element to a power source. The recess comprises an interior surface to expose a portion of the resistive heating element. An intermediate layer is disposed on the interior surface and on the portion of the resistive heating element. An active brazing material is disposed between the intermediate layer and the terminal for bonding the terminal to the intermediate layer. The intermediate layer is selected from a group consisting of molybdenum/aluminum nitride (Mo/AlN) and tungsten/aluminum nitride (W/AlN).

In yet another form, a joined structure is provided that comprises a ceramic substrate, a metallic member, and an intermediate layer disposed between the metallic member and the ceramic substrate for connecting the metallic member to the ceramic substrate. The intermediate layer is selected from a group consisting of molybednum/aluminum nitride (Mo/AlN) and tungsten/aluminum nitride (W/AlN).

In still another form, a method of securing a terminal to a ceramic heater is provided, wherein the ceramic heater includes a ceramic substrate and a resistive heating element. The method comprises exposing a portion of the resistive heating element; applying an intermediate layer on at least one of the portion of the resistive heating element and the ceramic substrate proximate the portion of the resistive heating element; and bonding the terminal to the intermediate layer. The intermediate layer being selected from a group consisting of Mo/AlN and W/AlN.

In still another form, a method of securing a terminal to a ceramic heater including a ceramic substrate and a resistive heating element is provided. The method comprises forming a recess in the ceramic substrate to expose a portion of the resistive heating element, the recess defining an interior surface; forming an intermediate layer in a form of paste on the interior surface and the portion of the resistive heating element, the intermediate layer being selected from a group consisting of Mo/AlN and W/AlN; sintering the intermediate layer, the resistive heating element, and the ceramic substrate; adjusting the intermediate layer to a size for receiving the terminal; applying an active brazing material on the intermediate layer; placing the terminal within the recess; and heating the active brazing material under vacuum, thereby bonding the terminal to the intermediate layer.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Corresponding reference numerals indicate corresponding parts throughout the several views of the drawings.

DETAILED DESCRIPTION

Figure 1:
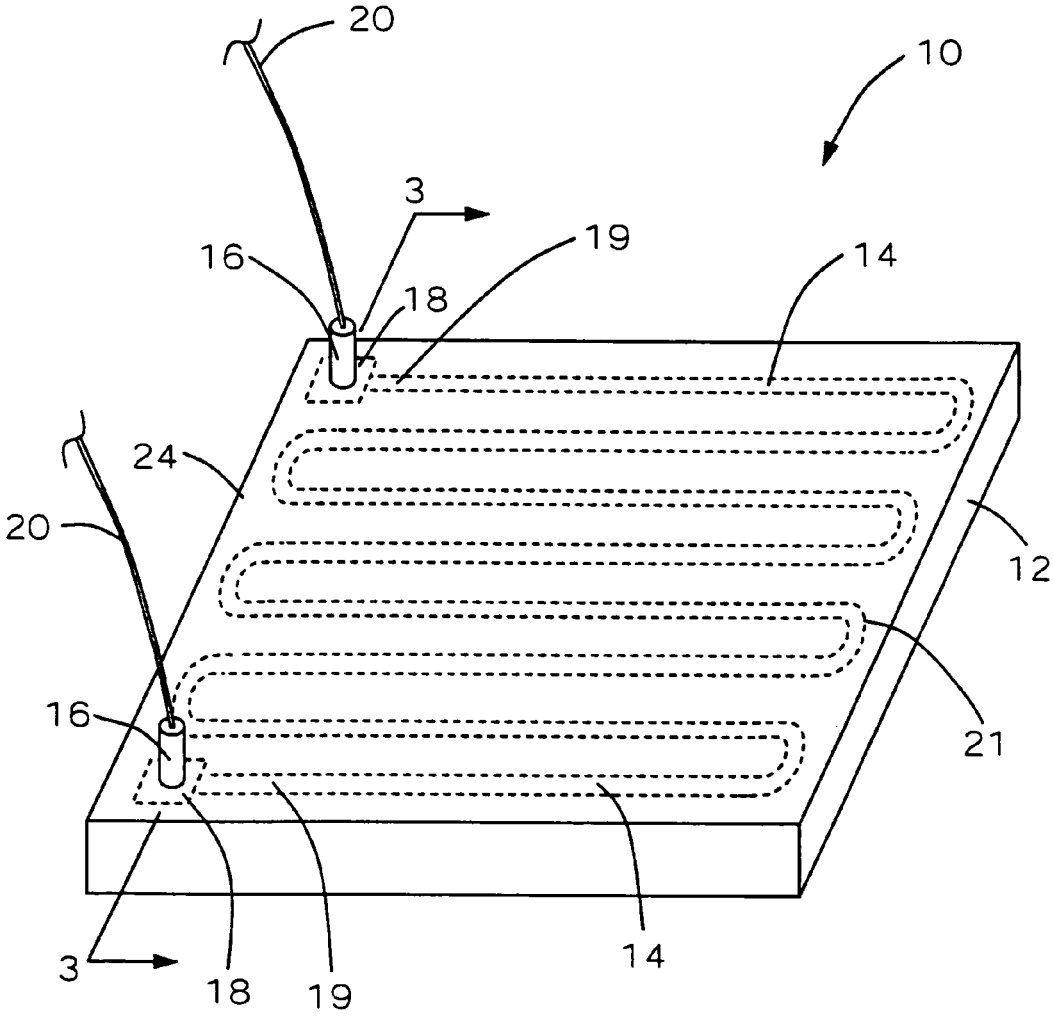
FIG. 1 is a perspective view of a ceramic heater and a pair of power terminals constructed in accordance with the teachings of the present disclosure.

The following description is merely exemplary in nature and is not intended to limit the present disclosure, application, or uses. It should be understood that throughout the drawings, corresponding reference numerals indicate like or corresponding parts and features.

Referring to FIG. 1, a ceramic heater constructed in accordance with the teachings of the present disclosure is illustrated and generally indicated by reference number 10. The ceramic heater 10 includes a ceramic substrate 12, a resistive heating element 14 (shown dashed) embedded within the ceramic substrate 12, and a pair of power terminals 16. The resistive heating element 14 is terminated at two terminal pads 18 (shown dashed) on which the power terminals 16 are attached for connecting the resistive heating element 14 to a power source (not shown) through lead wires 20. The ceramic substrate 12 is preferably made of aluminum nitride (AlN). The resistive heating element 14 can be of any type known in the art, such as, by way of example, a resistive coil, or a resistive film, among others.

The terminal pads 18 preferably have an enlarged area, compared with other portions of the resistive heating element 14, for ease of connection between the power terminals 16 and the resistive heating element 14. Alternatively, the terminal pads 18 are formed of a material different from that of the resistive heating element 14 and/or by a method different from that forming the resistive heating element 14. Alternatively, the terminal pads 18 are formed by the two opposing ends 19 of the resistive heating element 14, thus having the same material and width of a resistive circuit 21 (e.g., serpentine pattern as shown) defined by the resistive heating element 14.

Figure 2:
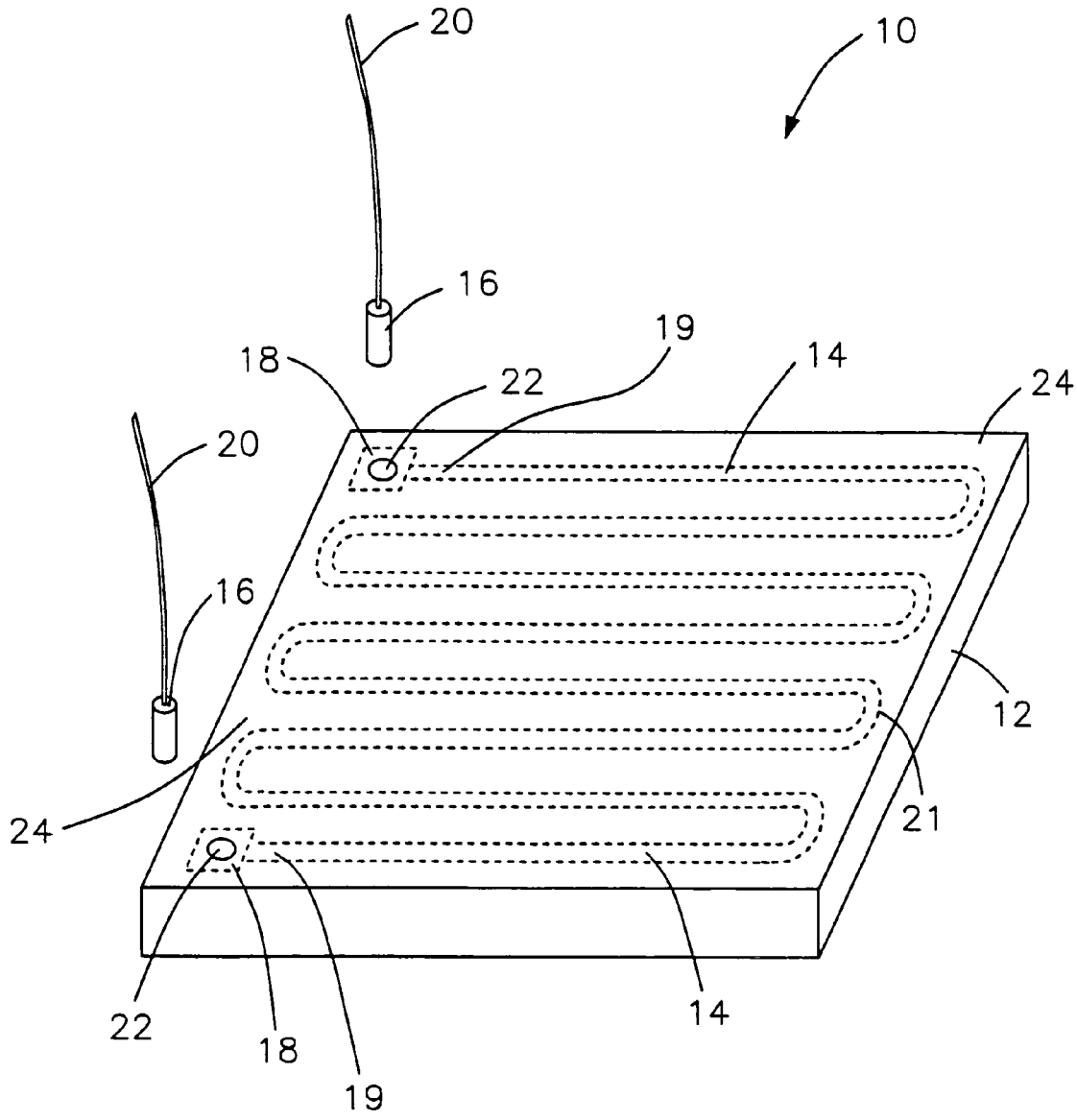
FIG. 2 is an exploded perspective view of the ceramic heater and the power terminals of FIG. 1 in accordance with the teachings of the present disclosure.
Figure 3:
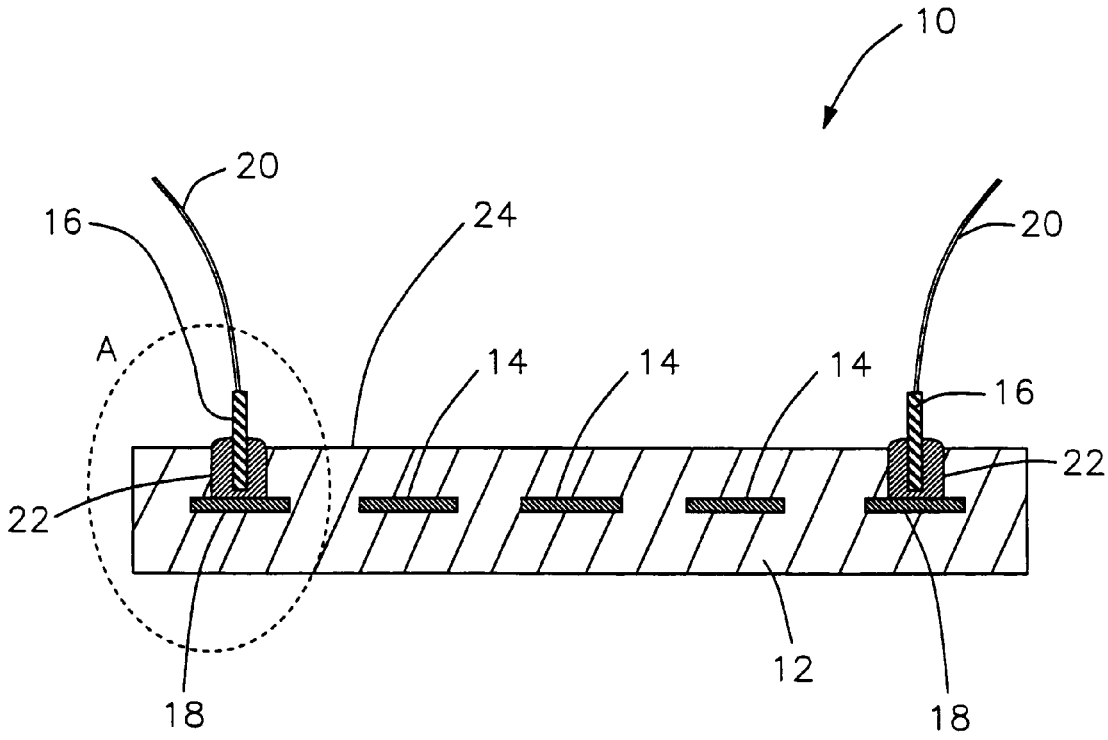
FIG. 3 is a cross-sectional view of the ceramic heater and the power terminals, taken along line 3-3 of FIG. 1, in accordance with the teachings of the present disclosure.

Referring to FIGS. 2 and 3, the ceramic substrate 12 defines a pair of recesses 22 extending from the terminal pads 18 to an exterior surface 24 of the ceramic substrate 12. The pair of power terminals 16 is disposed within the recesses 22.

Figure 4:
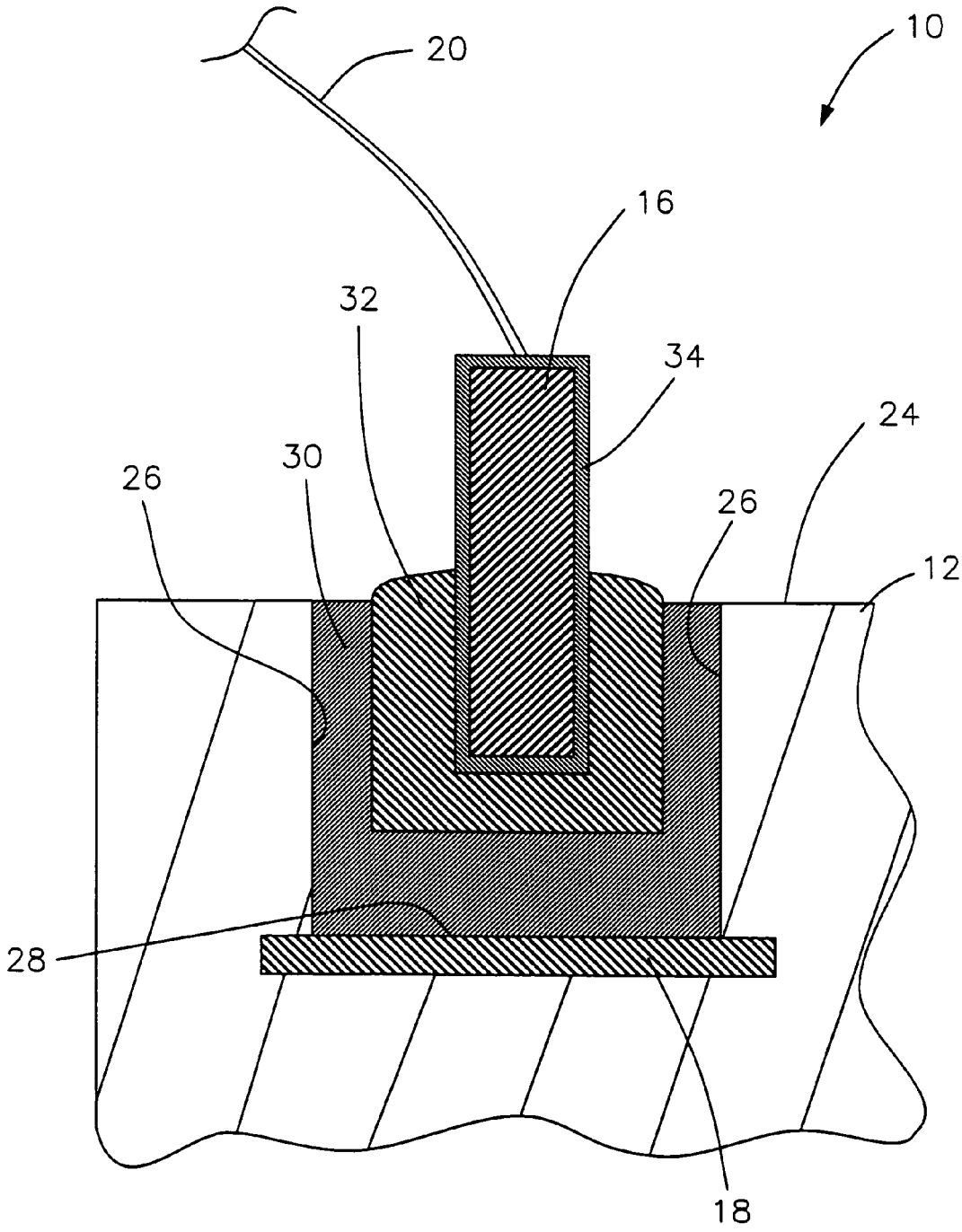
FIG. 4 is an enlarged view, within Detail A of FIG. 3, showing the bond between one of the power terminals and the ceramic heater in accordance with the teachings of the present disclosure.

As more clearly shown in FIG. 4, the recess 22 includes a side surface 26 and a bottom surface 28. The terminals pad 18 is shown in FIG. 4 to define the bottom surface 28. However, when the recess 22 is made larger than the terminal pad 18, the bottom surface 28 may be defined by both the terminal pad 18 and the ceramic substrate 12. The side surface 26 and the bottom surface 28 are covered by a intermediate layer 30, which may be made of molybdenum/aluminum nitride (Mo/AlN) or tungsten/aluminum nitride (W/AlN).

Disposed between the intermediate layer 30 and the power terminal 16 is an active brazing material 32 for bonding the power terminal 16 to the intermediate layer 30. The active brazing material 32 is preferably an active brazing alloy. The preferred active brazing alloy includes Ticusil® (Ag—Cu—Ti alloy), Au—Ti alloy, Au—Ni—Ti alloy, and Silver ABA®, (Ag—Ti alloy).

As shown in FIG. 4, the intermediate layer 30 covers the entire interior surface of the recess 22 including the side surface 26 and the bottom surface 28 of the recess 22. Alternatively, the intermediate layer 30 may be provided on the side surface 26 only, when the bottom surface 28 is substantially defined by the terminal pad 18 because the connection between the active brazing material 32 and the terminal pad 18 would not pose a problem, as would be the case if the active brazing material 32 were in contact with the ceramic substrate 12.

The intermediate layer 30, which is made of Mo/AlN or W/AlN has an intermediate coefficient of thermal expansion between that of the ceramic substrate 12 and that of the active brazing material 32. As a result, the thermal stress that might occur at the interface between the ceramic substrate 12 and the active brazing material 32 at high temperatures can be reduced. Moreover, the intermediate layer 30 has higher mechanical strength and fracture toughness than that of the AlN ceramic substrate 12. Therefore, the intermediate layer 30 is able to absorb more thermal stress and prevent cracks from occurring in the AlN ceramic substrate 12.

The intermediate layer 30 may be formed to have a variable concentration of Mo or W to adapt to the AlN ceramic substrate 12 and the composition of the active brazing material 32 and the range of operating temperatures of the ceramic heater 10. For example, the AlN ceramic substrate 12 generally has a flexural strength of approximately 368.6±61.5 MPa and a fracture toughness of approximately 2.9±0.2 $MPa \cdot m^{1/2}$. An intermediate layer 30 of Mo/AlN layer having 25/% volume percentage of Mo generally has a flexural strength of approximately 412.0±68.8 MPa and a fracture toughness of approximately 4.4±0.1 $MPa \cdot m^{1/2}$. An intermediate layer 30 of Mo/AlN layer having 45% volume percentage of Mo has a flexural strength of approximately 561.3±25.6 MPa and a fracture toughness of approximately 7.6±0.1 $MPa \cdot m^{1/2}$.

The power terminals 16 are preferably in the form of a pin as shown, however, other geometries may be employed while remaining within the scope of the disclosure. A commonly used power terminal is a Kovar® pin, which is made of a Co—Fe—Ni alloy. Other preferred materials for the power terminals 16 include nickel, stainless steel, molybdenum, tungsten and alloys thereof. When the power terminals 16 are made of a material other than Ni, a Ni coating 34 over the power terminal 16 is preferred to protect the power terminal 16 from oxidation at high temperatures.

Figure 5:
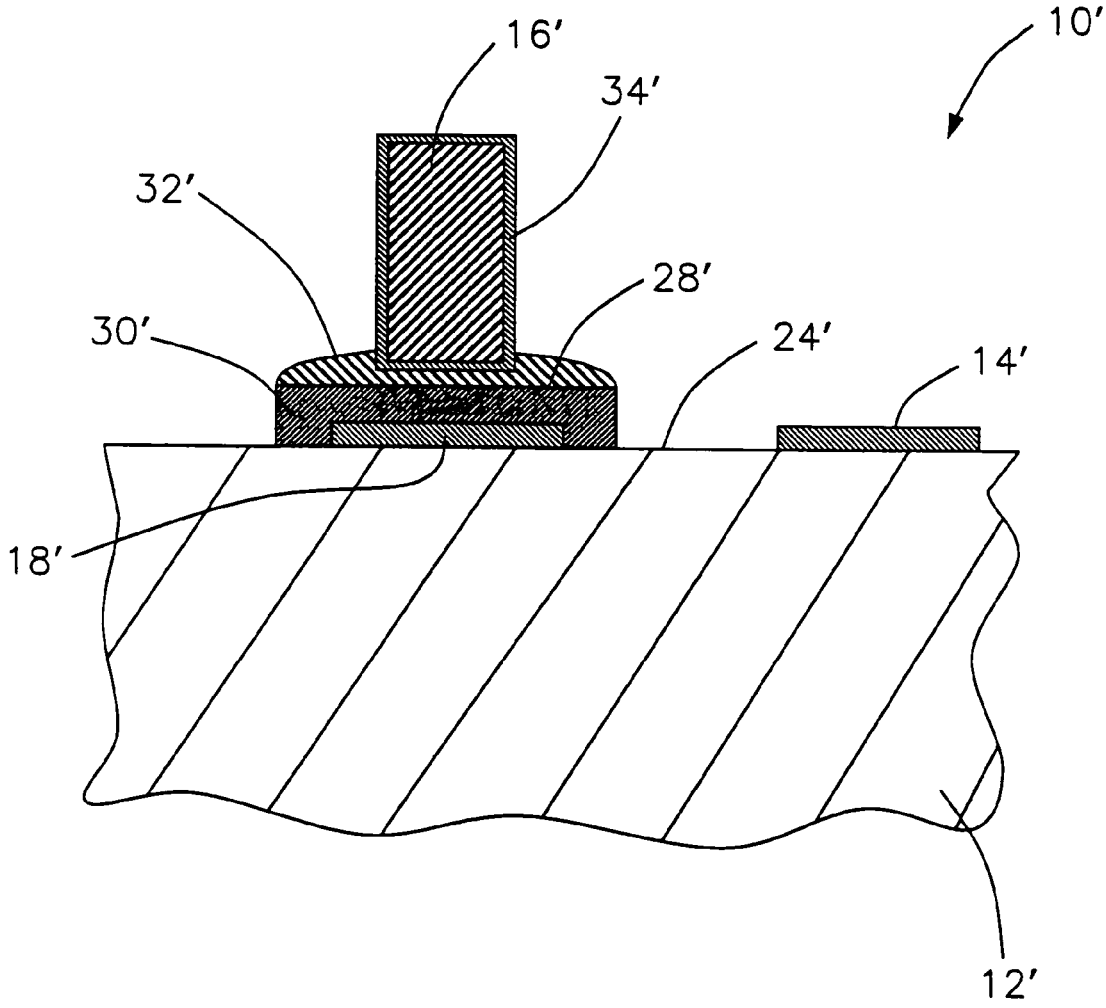
FIG. 5 is an enlarged view, similar to FIG. 4, showing an alternate bonding between the power terminal and the ceramic heater.

Referring to FIG. 5, a ceramic heater 10' is shown to have an alternate bonding between the power terminal 16' and the ceramic substrate 12'. In the following, like reference numerals are used to refer to like elements in FIGS. 1 to 4.

As shown, a resistive heating element 14' and a terminal pad 18' extending from the resistive heating element 14' are disposed on the exterior surface 24' of the ceramic substrate 12'. The terminal pad 18' and the ceramic substrate 12' proximate the terminal pad 18' are covered by an intermediate layer 30'. The intermediate layer 30' includes a Mo/AlN alloy or a W/AlN alloy, or both. An active brazing material 32' is applied on the intermediate layer 30' for connecting a power terminal 16' to the intermediate layer 30'. The power terminal 16' is preferably covered by a nickel coating 34' to avoid oxidation at high temperatures. Again, because the intermediate layer 30' has a coefficient of thermal expansion between that of the active brazing material 32' and that of the ceramic substrate 12', the thermal stress generated in the ceramic substrate 12' at high temperatures can be reduced, thereby reducing generation of cracks in the ceramic substrate 12'.

Figure 6:
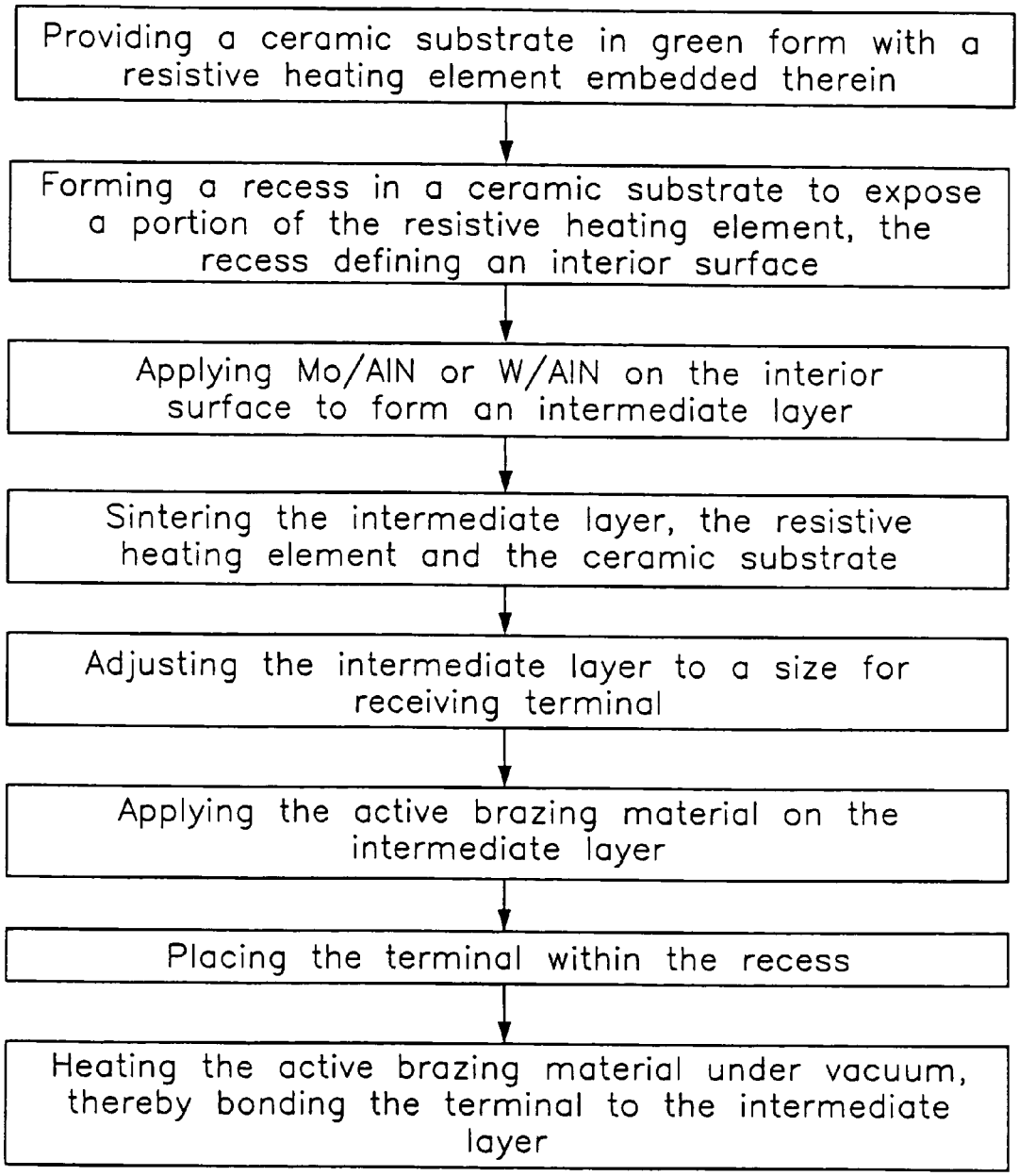
FIG. 6 is a flow diagram showing a method of securing a power terminal to a ceramic heater in accordance with the teachings of the present disclosure.

Referring now to FIG. 6, a method of securing the power terminals 16 to the ceramic substrate 12 in accordance with the teachings of the present disclosure is now described. It should be understood that the order of steps illustrated and described herein can be altered or changed while remaining within the scope of the present invention, and as such, the steps are merely exemplary of one form of the present disclosure.

First, the ceramic substrate 12 made of AlN matrix in green form is provided with the resistive heating element 14 embedded therein. The ceramic substrate 12 can be formed by powder pressing or green tape forming, slip casting, among other methods. The resistive heating element 14 is formed by any of conventional methods, such as screen printing, direct writing, among others.

Next, the ceramic substrate 12 is preferably drilled to form two recesses 22 to expose a portion of the resistive heating element 14, particularly the terminal pads 18. The recesses 22 are slighter larger than the outside diameter of the power terminals 16 to be inserted.

Thereafter, Mo/AlN or W/AlN in the form of a paste is applied within the recesses 22. For improved bonding and protection, the Mo/AlN or W/AlN is applied on both the side wall 26 and the bottom wall 28 as previously described and illustrated. The ceramic substrate 12 with the Mo/AlN or W/AlN paste is then placed in an oven (not shown) and heated to remove the solvent in the Mo/AlN or W/AlN paste to form the intermediate layer 30.

Then, the ceramic substrate 12 and the intermediate layer 30 are sintered at about 1700° C. to 1950° C. for about 0.5 to 10 hours to consolidate the resistive heating element 14 within the ceramic substrate 12 and the intermediate layer 30 within the recesses 22, thereby achieving a sintered ceramic substrate 12.

After the sintering process, the recesses 22 are straightened preferably by a diamond drill, to remove a surface porous layer (not shown) formed on the intermediate layer 30 during the sintering process to expose the dense Mo/AlN or W/AlN.

Next, the active brazing material 32 is applied in the form of a paste to the intermediate layer 30, and the power terminals 16 are inserted into the recesses 22 and are thus surrounded by the active brazing material 32. Before inserting the power terminals 16, it is preferable to coat a Ni layer on the power terminals 16 by electrodeless plating to protect the power terminals 16.

When the power terminals 16 are held in place, the active brazing material 32 in the form of a paste is dried at room temperature or elevated temperature for a period of time sufficient to evaporate the solvent. After the paste is dried, the ceramic heater 10 with the power terminals 16 is placed inside a vacuum chamber. The entire assembly is heated to 950° C. under a pressure of $5\times10^{-6}$ torr for about 5 to 60 minutes to complete the brazing process. Then, the vacuum chamber is cooled to room temperature, thereby completing the process of securing the power terminal 16 to the ceramic heater 10.

According to the present disclosure, the power terminals 16 are bonded to the terminal pad 18 and the ceramic substrate 12 proximate the terminal pads 18 through the intermediate layer 30. Since the intermediate layer 30 has a coefficient of thermal expansion between that of the aluminum nitride ceramic substrate and that of the active brazing material 32, the thermal stress generated in the ceramic substrate 12 at high temperatures can be reduced, thereby reducing generation of cracks in the ceramic substrate 12 proximate the recesses 22.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A ceramic heater comprising:

a ceramic substrate;

a resistive heating element attached to the ceramic substrate;

a terminal pad in contact with the resistive heating element;

a terminal adapted for electrically connecting the resistive heating element and the terminal pad to a power source;

an active brazing material disposed proximate the terminal; and an intermediate layer disposed between the active brazing material and the ceramic substrate and in contact with the terminal pad, the intermediate layer having a variable composition selected from the group consisting of molybdenum/aluminum nitride (Mo/AlN) and tungsten/aluminum nitride (W/AlN) and having a coefficient of thermal expansion between that of the ceramic substrate and that of the active brazing material and having higher mechanical strength and fracture toughness than that of the ceramic substrate to adapt to the ceramic substrate and active brazing material over the range of operating temperatures of the ceramic heater.

2. The ceramic heater according to claim 1, wherein the ceramic substrate defines a recess and a portion of the terminal is disposed within the recess.

3. The ceramic heater according to claim 2, wherein the intermediate layer is disposed within the recess.

4. The ceramic heater according to claim 1, wherein the active brazing material is selected from a group consisting of Au—Ti alloy, Au—Ni—Ti alloy, Ag—Cu—Ti alloy, and Ag—Ti alloy.

5. The ceramic heater according to claim 1, wherein the terminal is a pin made of a material selected from a group consisting of Co—Fe—Ni alloy, nickel, stainless steel, molybdenum and tungsten.

6. The ceramic heater according to claim 1, wherein the terminal includes a nickel coating.

7. The ceramic heater according to claim 1, wherein the ceramic substrate is made of aluminum nitride (AlN).

8. A ceramic heater comprising:

a ceramic substrate including a recess, the recess comprising an interior surface;

a resistive heating element embedded within the ceramic substrate, a portion of the resistive heating element being exposed to the recess;

a terminal pad in contact with the resistive heating element;

a terminal for connecting the resistive heating element and the terminal pad to a power source;

an intermediate layer disposed on the interior surface and on the portion of the resistive heating element, the intermediate layer being in contact with the terminal pad; and an active brazing material disposed between the intermediate layer and the terminal for bonding the terminal to the intermediate layer, wherein the intermediate layer has a variable composition selected from the group consisting of molybdenum/aluminum nitride (Mo/AlN) and tungsten/aluminum nitride (W/AlN) and has a coefficient of thermal expansion between that of the ceramic substrate and that of the active brazing material and has a higher mechanical strength and fracture toughness than that of the ceramic substrate to adapt to the ceramic substrate and active brazing material over the range of operating temperatures of the ceramic heater.

* * * * *